United States Patent [19]

Bailey

[11] 4,416,340

[45] Nov. 22, 1983

[54] ROTARY DRILLING HEAD

[75] Inventor: Edmond I. Bailey, Houston, Tex.

[73] Assignee: Smith International, Inc., Newport Beach, Calif.

[21] Appl. No.: 334,372

[22] Filed: Dec. 24, 1981

[51] Int. Cl.[3] ..... E21B 3/02

[52] U.S. Cl. ..... 175/195; 175/210; 285/365; 277/31; 81/464

[58] Field of Search ..... 175/195, 209, 210; 166/82-84; 277/31; 81/464; 173/93.5; 285/365, 366, 407, 411, 18, DIG. 13

[56] References Cited

U.S. PATENT DOCUMENTS

| | | | |
|---|---|---|---|
| 3,703,933 | 11/1972 | Schoeps | 173/93.5 X |
| 3,965,987 | 6/1976 | Biffle | 166/84 X |
| 4,281,724 | 8/1981 | Garrett | 166/84 X |
| 4,293,047 | 10/1981 | Young | 277/31 X |
| 4,312,404 | 1/1982 | Morrow | 277/31 X |

*Primary Examiner*—Ernest R. Purser
*Assistant Examiner*—Thuy M. Bui
*Attorney, Agent, or Firm*—David A. Rose; Murray Robinson; Ned L. Conley

[57] ABSTRACT

In accordance with the present invention, the drilling head includes a body or spool having a flow bore and a removable side outlet. Upon removal of the side outlet, the drilling head further includes a closure member for closing the annulus between that portion of the drilling head above the side outlet and a drive tube, such as a kelly, extending through the drilling head flow bore. The closure member includes a nonrotating support tube and a rotating seal tube adapted to form a nonrotating seal with the drive tube. The seal tube is rotatably supported by bearings within the support tube. The closure member is small enough to pass through even rotary tables that are too small to pass the drilling head.

A segmented clamp secures the closure member to the drilling head body around one end of the flow bore. The clamp includes at least two segments, for fast actuation, having one end connected to a variable length linkage. The variable length linkage includes a nut pivotally connected to one segment, a screw engaging the nut, and a pivotal connection connecting the screw to another segment.

The segmented clamp is tightened and released by a remote controlled, variable torque impact motor. The motor is housed within a support bracket mounted on the segmented clamp and is connected to the screw of the variable length linkage by a drive connection. Springs bias the motor against the screw. The motor fits loosely within the support bracket and is permitted limited movement in all directions.

The impacting variable torque motor applies a series of rotational hammer blows to the screw to break the connection and then a smooth normal torque to continue the disengagement of the clamp.

11 Claims, 7 Drawing Figures

7
7
6
6

254
40
14
252
246
206
212
258
204
260
230
24
173
172
222
174
210
224
180
70
228
96
200
202
208
244
248

250
254
280
276
278
274
226
270
272
230
228
224
282
266
222
188
268

256
278
266
262
268
254
264

ROTARY DRILLING HEAD

BACKGROUND OF THE INVENTION

This invention relates to rotary drilling heads for earth boring apparatus, and more particularly, to remotely controlled clamps with a driving variable torque motor for connecting to the drilling head body a part of the drilling head to be removed through a rotary table.

In conventional drilling by the rotary method, a drilling head surmounts the stack of drilling equipment for permitting the drilling fluid in the well to exit the annulus around the drill string and for sealing between the upper end of the drilling stack and the rotating drill string extending therethrough and down into the well. A typical drilling head includes a tubular body having a side outlet for exiting the drilling fluid and a bottom flange for connection to a blowout preventer or other drilling stack member. The drilling head also includes a seal between the body of the drilling head and the kelly or top joint forming the drive for the drill string.

A typical drilling head assembly includes a main housing having an upper stationary housing rigidly affixed to the main housing by a split clamp assembly encircling outwardly directed flanges disposed on the upper stationary and main housings. The main housing has a lower flange for connection to the borehole casting and an integral outlet port to conduct fluid flow from the borehole annulus. The upper stationary housing rotatably receives a rotating bowl with roller bearings therebetween. Seals are provided to prevent contamination of the roller bearings. A stripper is affixed to the lower end of the rotating bowl and includes a rotating seal member to sealingly engage the main housing above the outlet port and an interior sealing surface for sealingly engaging the kelly or drive tube extending through the drilling head. A threaded nut is provided to retain the rotating bowl within the upper stationary housing.

The drilling head is located just below the rotary table. The rotary table has an aperture for the master bushing which in turn has an aperture for the drive bushing which rotates the kelly or drive tube. The drive bushing also has an aperture which will not pass over the connector joint at the lower end of the kelly. When it is necessary to elevate the kelly out of the drilling head, as when adding a joint of drill pipe or when removing the drill string from the well bore to change the drill bit, the drive bushing lifts out of the aperture in the master bushing and the kelly connector then passes up through the rotary table.

During installation or possibly during operation, it is necessary to remove a portion, such as the rotating bowl and/or upper stationary housing, or all of the drilling head from underneath the rotary table. Rotary heads, such as that disclosed in U.S. Pat. No. 4,285,406 entitled "Drilling Head," are dimensioned to permit the removal of the drilling head through the aperture in the rotary table upon disconnection of the side outlet.

The rotating bowl and upper stationary housing of the drilling head may be removed by unclamping the flanges on the upper stationary and main housings. It is preferred that such clamp be disengaged from a remote position above the rotary table. Such a clamp and hydraulic motor are disclosed in the above mentioned U.S. Pat. No. 4,285,406.

Another type of clamp and clamp opening and closing device is disclosed in U.S. Pat. No. 3,661,409 to Brown et al. The Brown clamp comprises a plurality of arcuate segments having wedging surfaces for engaging corresponding flanges on the mating apparatus to be connected. The ends of the clamp are connected to a clamp opening and closing device. Other than at the ends of the clamp, the adjacent arcuate segments are hinged to one another at the top and bottom by clamp hinges in the form of elongated rigid links.

The Brown clamp opening and closing device includes a drive screw having two axially spaced portions which are helically threaded in an opposite sense from one another and a cranking portion of non-circular section for receipt of an air motor chuck, hydraulic motor chuck, hand crank, or the like for rotating the drive screw about its longitudinal axis. Received on threaded portions of the drive screw in driven relationship thereto are trunnions which include vertically upwardly and vertically downwardly extending stub axle pins. Four elongated rigid links connect the two near hinge pins at the ends of the clamp to the respective trunnions so that rotation of the drive screw in a first sense will generally radially contract the clamp by transmission of force through the links, pins and segments and so that rotation of the drive screw in a second, opposite sense will generally radially expand the clamp.

In operation, the drive screw of the Brown clamp is rotated clockwise which will draw the two trunnions circumferentially together, since a left and right hand threaded arrangement is provided on these units. As the clamp begins to circumferentially draw together, camming guide slots control the movement of the clamp segments whereby the back of the clamping unit is brought into contact with the flanges first. The clamping segments along the sides of the unit are drawn initially forward toward the drive unit and then are allowed to engage the hub segments after the back segment has become partially engaged. To open the unit, the drive screws are then turned counterclockwise at which time the trunnions begin to circumferentially separate. As the front clamp segments move outward and contact the retaining can, an external camming force, causing tangential circumferential loads to be applied to the remaining segments, sequentially forces the remaining clamp segments off the flange tapers. In the full open position, all of the clamp segments are wedged back against the inside of the retaining can and the clamp is centered around the flange O.D. The top apparatus may then be removed.

Because drilling heads are located in an almost inaccessible location under the rotary drilling table, and because the clamp segments and drive screw tend to corrode and freeze, it is almost imperative that the clamp be opened by motor driven mechanical means rather than manually. Although the prior art teaches the use of air and hydraulic motors, such hydraulic motors emit a constant torque and without impacting the nut and screw. Often such prior art motors are unable to break open the clamp due to the corrosion inherent at the drilling location.

Impact wrenches are well known for use in tightening or loosening threaded fasteners, such as bolts and nuts. One type of impact wrench is disclosed in U.S. Pat. No. 3,414,066. The wrench includes a housing in which is supported a pneumatically powered motor of the conventional slidable blade type with a driving shaft. The motor has a splined driving connection between the shaft and a rotatable hammer. The hammer is bearing supported within the housing and is retained against axial movement. The hammer has another splined driving connection with a rotatable impacting dog. The dog has a normal retracted position and on its forward face anvil impacting jaws. During operation the dog is periodically advanced axially on the splined connection by cams into impacting relation with an anvil. The anvil is journaled for rotation in the nose of the housing and has an external shank end for driving connection with a work socket. The socket is suited for drivingly engaging work, which may be a bolt head, nut, or other threaded fastener. A repetitive impact action occurs upon revolution of the dog relative to the cam and anvil so that the impact is repeated upon every revolution of the dog.

It is desirable to have the ability to remove and replace the top closure member of a drilling head without going below the rig floor to dismantle the drilling head and slip it out from underneath the rig floor. The top closure member includes the rotating portion and upper stationary portion of the drilling head. To avoid this problem, it is necessary that the top closure member of the drilling head be easily removable from the drilling head and dimensioned so as to pass through the apertures in the rotary table. Further, it is desirable not to have to disconnect lubrication lines for lubricating the rotating parts of the drilling head prior to removing the top closure member.

As shown in the prior art, the top closure member is generally connected to the body of the drilling head by a clamp. It defeats the object of avoiding going below the rig floor if the clamp cannot be activated remotely such as from above the rig floor. Manual and motor drive mechanisms have been unsuccessful in the prior art where the clamp segments and/or drive screws have corroded and frozen, preventing their activation. The present invention provides such desirable features as a removable drive bushing, removable rotor, removable stator and a removable side outlet, all of which will pass through the master bushing opening of a standard rotary drilling table, and a clamp and clamp opening and closing device driven by an impacting variable torque motor which will permit an impacting torque to break open the clamp and a lesser constant torque for the continued opening of the clamp.

Other objects and advantages of the invention will appear from the following description thereof.

SUMMARY OF THE INVENTION

In accordance with the present invention, the drilling head includes a body or spool having a flow bore and a removable side outlet. Upon removal of the side outlet, the drilling head will pass through most rotary tables. The drilling head further includes a top closure member for closing the annulus between that portion of the drilling head above the side outlet and a drive tube, such as a kelly, extending through the drilling head flow bore. The top closure member includes a nonrotating support tube and a rotating seal tube adapted to form a nonrotating seal with the drive tube. The seal tube is rotatably supported by bearings within the support tube. The top closure member is small enough to pass through even rotary tables that are too small to pass the drilling head.

A segmented clamp secures the top closure member to the drilling head body around one end of the flow bore. The clamp includes at least two segments, for fast actuation, having one end connected to a variable length linkage. The variable length linkage includes a nut pivotally connected to one segment, a screw engaging the nut, and a pivotal connection connecting the screw to another segment.

The segment clamp is tightened and released by a remote controlled, impacting, variable torque impact motor. The motor is housed within a support bracket mounted on the segmented clamp and is connected to the screw and the variable length linkage by a drive connection. Springs bias the motor against the screw. The motor fits loosely within the support bracket and is permitted limited movement in all directions.

The impacting variable torque motor applies a high impacting torque to the screw to break the connection and then a low torque to continue the disengagement of the clamp.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
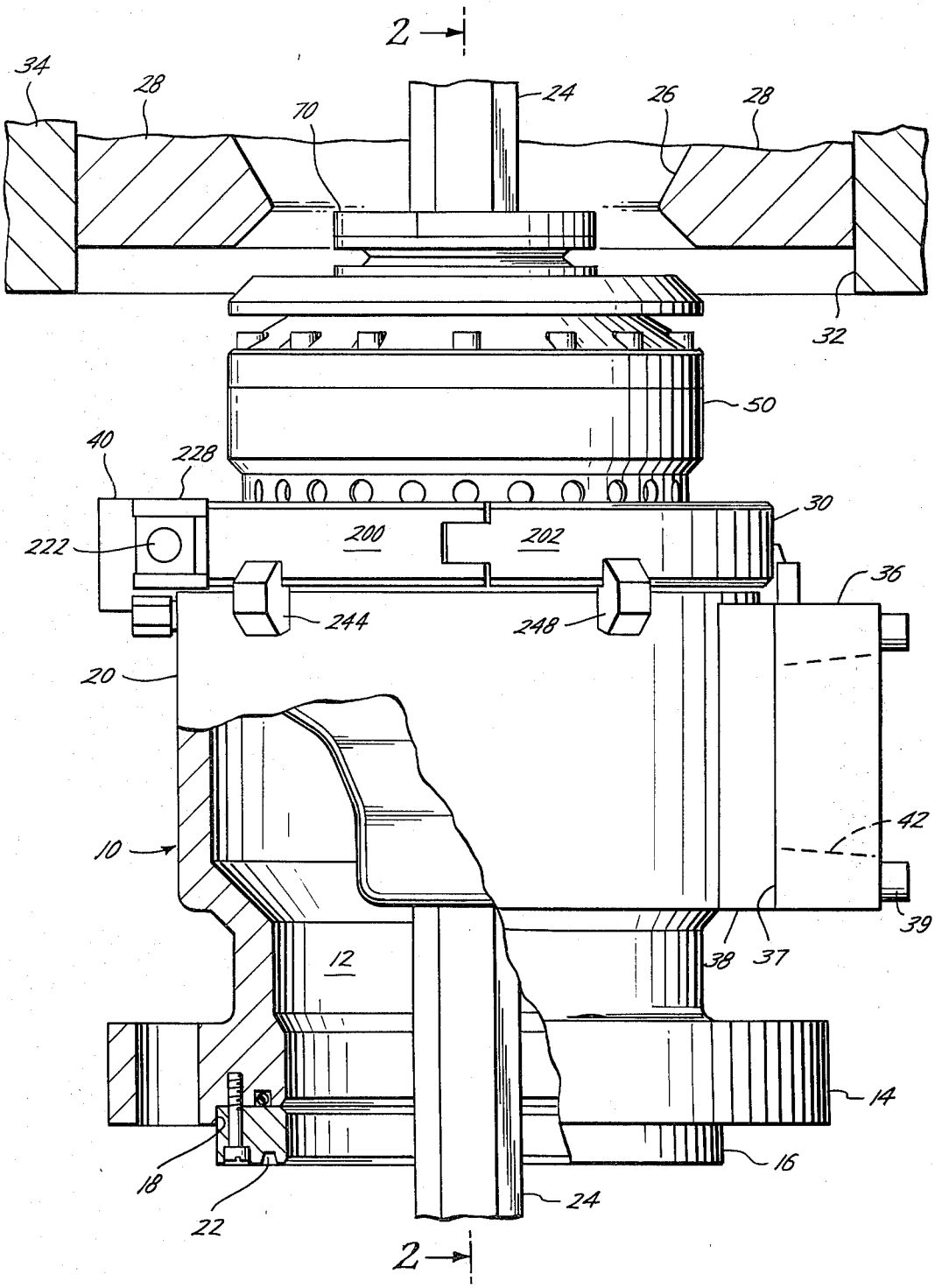
FIG. 1 is an elevation, partly in section, showing a drilling head incorporating the invention.
Figure 2:
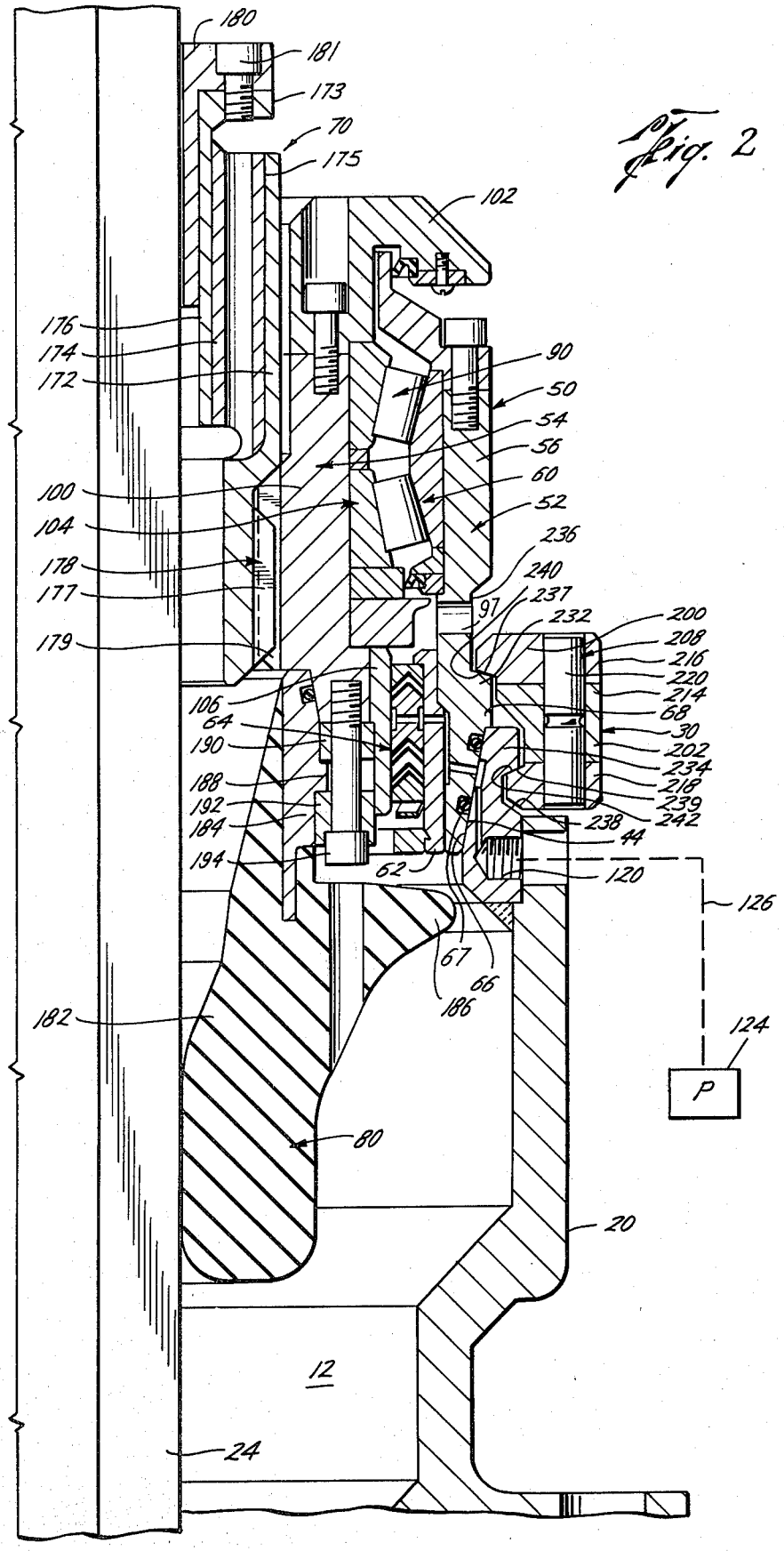
FIG. 2 is a vertical section at plane 2—2 of FIG. 1.

Referring initially to FIG. 1, there is shown a drilling head, generally designated at 10, includes a tubular body 20, a clamp 30, a clamp opening and closing device 40, top closure member 50, a drive bushing 70, a stripper 80, and bearing means 90 (shown in FIG. 2). Tubular body 20 has a vertical flow passage 12 therethrough and a radial flange 14 for connecting drilling head 10 to the upper end of a drilling control stack, e.g., to the top of a blowout preventer. An adapter ring 16 may be secured in annular rabbet 18 at the lower inner periphery of flange 14 for receiving a steel ring gasket (not shown) in annular groove 22 for sealing to the top flange of the blowout preventer, or to another control stack member.

Body 20 of drilling head 10 is provided at one side with a rectangular boss 38 and a side port (not shown) which extends through body 20 and boss 38. A side outlet 36 is connected to boss 38 at face 37 by bolts 39. Side outlet 36 includes a threaded bore 42 for threadingly engaging a threaded pipe connected to a mud line or flowing line.

A kelly 24, not a part of drilling head 10, is shown extending through drilling head 10. Drilling head 10 is shown in operating position extending up into the lower part of aperture 26 in master bushing 28. Bushing 28 is removably mounted in opening 32 in rotary table 34. It will be seen that the diameter of flange 14 is small enough to pass through opening 32 in rotary table 24 when master bushing 28 is removed. It is therefore possible to lower tubular body 20, with side inlet 36 removed, through rotary table 34 to the top of the control stack. This eliminates the dangerous activity required when a drilling head is manipulated laterally under the rig floor and rotary table for installation. Since a drilling head is such a heavy body, elimination of such manipulation is of great advantage.

Referring now to FIG. 2, top closure member 50 and drive bushing 70 close the annulus between kelly 24 and the upper end of drilling head body 20. Top closure member 50 includes a removable outer stationary support member or stator 52 and a removable inner rotating seal member or rotor 54. Top closure member 50 and drive bushing 70 are releasably secured to the upper end of drilling head body 20 by clamp 30 remotely controlled and actuated by means of clamp opening and closing device 40 (shown in FIG. 3).

The removable outer stationary support member or stator 52 includes an outer support tube 56, an outer retainer and seal flange 58, outer bearing support means 60, a seal support bushing 62, and a cylindrical stationary seal packing cartridge 64. An outer stationary bowl 65 is provided at the upper end of drilling head body 20 and includes a conical seat 66 for supporting stator 52. Outer support tube 56 of stator 52 has a conically tapered surface 44 at its lower end which is supported and centered by seat 66. An external stop shoulder 68 on outer support tube 56 rests on top of bowl 65 to limit the engagement of tapered surface 44 and seat 66 to insure that stator 52 can be easily removed from body 20. O-ring seals 67 are provided in annular grooves in surface 44 for sealing engaging seat 66.

Figure 4:
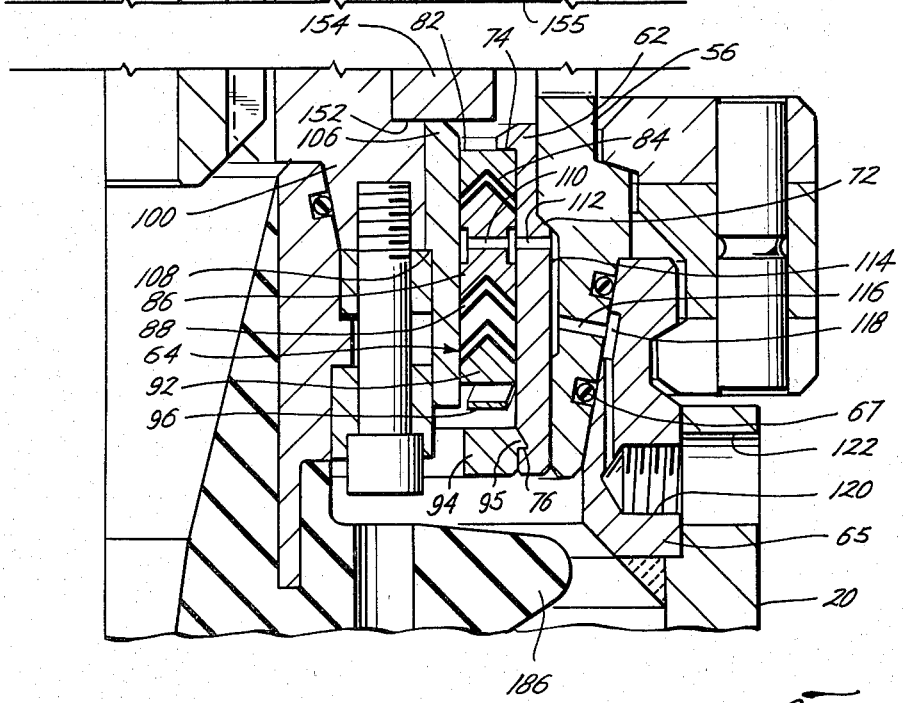
FIG. 4 is an enlarged section view of the rotating seal between the rotor and stator of the drilling head shown in FIG. 2.

Referring now to FIG. 4, seal support bushing 62 and cylindrical stationary seal packing cartridge 64 are received within the lower end of outer support tube 56. Seal support bushing 62 is shrunk fit within outer support tube 52 for supporting packing cartridge 64. Mating annular shoulders are provided on the interior and exterior of outer support tube 52 and bushing 62, respectively, at 72 to limit the reception of bushing 62 within tube 52 and properly locates cartridge 64 within drilling head 10. Bushing 62 further includes a slight inturned flange forming downwardly facing internal shoulder 74 and an internal groove 76 in the lower inner periphery of bushing 62, both shoulder 74 and groove 76 being used to retain packing cartridge 64 within bushing 62 as hereinafter described.

Cylindrical stationary seal packing cartridge 64 includes a hard upper end ring 82, a compliant seal ring 84, a hard separator ring 86, compliant chevron sea rings 88, and a hard lower end ring 92. Cartridge 64 is captured between shoulder 74 of bushing 62 and a split snap ring 94 having an outer annular lip 95 which snaps into inner peripheral grove 76 of bushing 62. A wave spring 96 is disposed between lower end ring 92 of cartridge 64 and split snap ring 94 to provide a compressive force to the ring stack of cartridge 64. Cartridge 64 provides a readily replaceable packing means for the rotating seal between stator 52 and rotor 54.

Should the packing cartridge 64 leak, the leaking fluid is vented to atmosphere by one or more pressure relief ports 97 in support tube 52, thus keeping bearing means 90 from being exposed to drilling fluid pressure.

Referring again to FIG. 2, the removable inner rotating seal member on rotor 54 includes an inner seal tube 100, an inner retainer and seal flange 102, inner bearing support means 104, and a rotating hard wear sleeve 106. Rotating hard wear sleeve 106 provides a rotating seal surface sealingly engaging cylindrical stationary seal packing cartridge 64. Sleeve 106 is telescopingly received over the lower end of inner seal tube 100 so as to be disposed opposite cartridge 64. Sleeve 106 is retained on tube 100 by its upper end engaging the lower end of lower annular support ring 154 of inner bearing support means 104 hereinafter described, and by an annular shoulder 108 around the inner periphery of sleeve 106 engaging upper retainer ring 190 of the retaining means for disposing stripper 80 onto the lower end of rotor 54 as hereinafter described.

Referring back to FIG. 4, to facilitate lubrication of the seal surface of wear sleeve 106, there is provided in bushing 62 and cartridge 64 one or more lubrication ports 110, 112 which communicate with an annular recess 114 in outer support tube 56. Annular recess 114 communicates with one or more ports 116 extending radially through outer support tube 56. Ports 116 communicate with annular groove 118 in the side of bowl 65. Socket 120 opens to radial port 122 through body 20 of drilling head 10. The outlet of an oil pump, shown schematically at 124, driven by suitable means not shown, is connected via oil line 126 to socket 120 to supply oil to the interior face of sleeve 106. Since oil line 126 connects directly to body 20 and only indirectly to outer support tube 56, there is no need to disconnect line 126 when top closure member 50 and/or drive bushing 70 are pulled from body 20 of head 10 when it is necessary to change the drill bit or other large drill string component.

Figure 5:
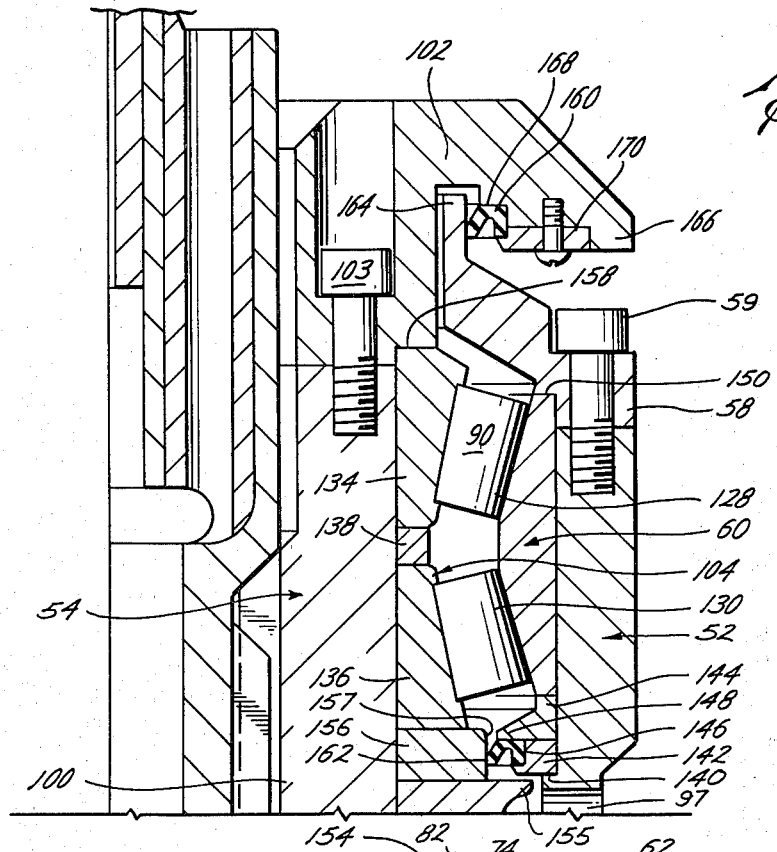
FIG. 5 is an enlarged section view of the bearing means of the drilling head shown in FIG. 2.

Referring now to FIG. 5, bearing means 90 are provided between outer bearing support means 60 of stator 52 and inner bearing support means 104 of rotor 54 in order to permit rotor 54 to easily rotate within stator 52. Bearing means 90 includes roller bearing cones 128, 130 disposed between outer bearing suport means 60 and inner bearing support means 104. Outer bearing support means 60 includes an outer bearing race 132 and inner bearing support means includes two inner bearing races 134, 136 separated by spacer ring 138.

Outer support tube 56 of stator 52 has an inwardly directed annular shoulder 140 on which is mounted a lower outer bearing block 142 and an upper annular support ring 144. Bearing block 142 has an upwardly facing rabbit 146 providing a sealing surface for lower downwardly facing double lip radial seal 162 hereinafter described and upper annular support ring 144 has an inwardly directed foot 148 for retaining lower radial seal 162 in sealing engagement. The upper surface of upper annular support ring 144 supports outer bearing race 132. Outer retainer and seal flange 58 of stator 52 includes a downwardly facing annular shoulder 150 engaging the upper end of outer bearing race 132 to retain outer bearing support means 60 on stator 52.

Inner seal tube 100 of rotor 54 has an outwardly directed annular shoulder 152 on which is mounted a lower annular support ring 154 and an inner bearing block 156. Lower annular support ring 154 includes a radial flange 155 to protect lower radial seal 162 and ring 154 supports inner bearing block 156. Upper inner bearing block 156 has an outer peripheral sealing surface 157 sealingly engaging lower radial seal 162. The upwardly facing surface of inner bearing block 156 supports lower inner bearing race 136. Inner retainer and seal flange 102 of rotor 54 includes a downwardly facing annular shoulder 158 engaging the upper annular surface of upper inner bearing race 134 to retain inner bearing means 104 on rotor 54.

Upper and lower downwardly facing double lip radial seals 160, 162, made of a flexible, resilient compliant sealing material such as rubber, seal between the stator 52 and rotor 54 above and below bearing means 90. Lower radial seal 162 is disposed in rabbit 146 of outer bearing block 142 and is captured therein by support ring 144 previously described. Lower radial seal 162 seals the peripheral sealing surface 157 of inner bearing block 156. Upper radial seal 160 is disposed between telescoping, axially extending inner and outer flanges 164, 166 of outer retainer and seal flanges 58 of stator 52 and inner retainer and seal flange 102 of rotor 54, respectively. Upper radial seal 160 is retained in an annular rabbit 168 in outer flange 166 by retainer ring 170 screwed into flange 166.

Inner and outer retainer and seal fanges 102, 58 are bolted to the tops of inner seal tube 100 and outer support tube 56 at 103, 59, respectively, to retain bearing means 90.

Referring now to FIG. 2, the lower end of inner seal tube 100 supports stripper 80 for sealing with kelly 24. The inner periphery of stripper 80 is funnel shaped to facilitate the downward passage of tool joints as for example when one of the drill strings is being reassembled and lowered into the hole after changing bits, or when the drill string is being lowered into the hole after another length of pipe has been added between the kelly and the uppermost piece of drill pipe in the string, as the hole is drilled deeper. Although the lower inner peripheral surface of stripper 80 is cylindrical, stripper 80 is sufficiently resilient to form a seal with a noncircular drive tube, e.g., with a square cross section kelly or with hex cross section kelly 24 as shown.

Stripper 80 includes a generally tubular elastomeric body 182 bonded to a stripper support sleeve 184. Body 182 includes a medial radial flange 186 for directing the upwardly flowing drilling fluid to side outlet 36. Stripper support sleeve 184 includes a short narrow external radial flange 188. Above flange 188 is an upper retainer ring 190 and below flange 188 is a lower retainer ring 192. Retainer rings 190, 192 have a plurality of registering holes which receive a plurality of cap screws 194 extending past the outer periphery of flange 188 to capture flange 188 between rings 190, 192 upon threading cap screws 194 into threaded bores in the lower end of inner support tube 100. A plurality of circumferentially spaced holes are provided in medial radial flange 186 to reach cap screws 194.

In order to insure that there is no relative rotation of stripper 80 and kelly 24 (or other drive tube), provision is made for driving inner seal tube 100 in synchronism with kelly 24. This is effected by means of drive bushing 70. Drive bushing 70 includes an outer seal sleeve 172, an elastomeric sleeve 174, and an inner steel sleeve 176 forming an annular elastomeric sandwich 175 received within rotor 54.

Figure 3:
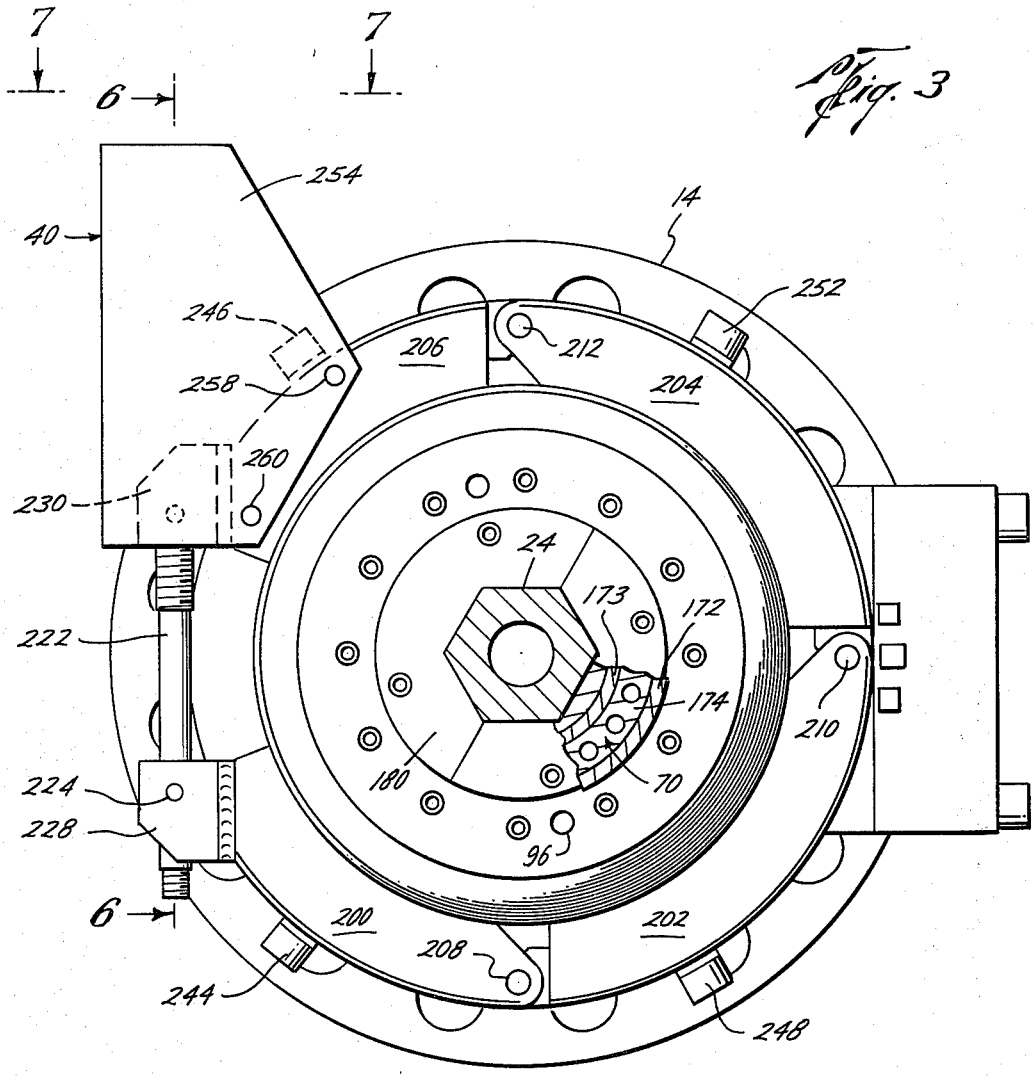
FIG. 3 is a top view of the drilling head incorporating the invention of FIG. 1.

Outer steel sleeve 172 includes two azimuthally spaced splines 177 which mesh with two correlative splines 179 azimuthally spaced apart on the inner periphery of inner seal tube 100. Thus, there is provided a spline means 178 connecting drive bushing 70 with inner seal tube 100. Inner steel sleeve 176 has an external radial flange 173 which extends over outer sleeve 172. Kelly slips or inserts 180 are releaseably secured at 181 to drive bushing 70. As shown in FIG. 3, slips 180 form a diametrically split ferrule whose inner periphery has a cross section correlative to that of the drive tube to be used with drilling head 10. As shown, the cross section is hexagonal to conform to hex kelly 24.

Summarizing, drilling head 10 is stratified as follows, proceeding from top to bottom: kelly slips 180 and sandwich 175; drive bushing 70, spline 178 and bearing means 90; rotating seal 64, 106 and clamp 30; stripper 80, kelly 24 and side port 36; and mounting flange 14. By so disposing the components, the maximum use is made of the vertical space below the rotary table enabling the whole head 10 to be lowered and raised through the more common $27\frac{1}{2}$ inch API rotary table and the top closure member and drive bushing to be lowered and raised through the smaller $17\frac{1}{2}$ inch API rotary table.

Referring to FIGS. 2 and 3, there is shown clamp 30 which secures the joint between top closure member 50 and body 20. Clamp 30 comprises a segmented ring which is divided into four, less than ninety degree (e.g., eighty degree) arcuate segments 200, 202, 204, 206. The four segments are pivotally connected together by three knuckle joints at 208, 210, 212.

As shown best in FIG. 2, each knuckle joint 208, 210, 212 includes an inner projection 214 on one segment extending between two outer projections 216, 218 on the adjacent segment and a pin 220 extending through holes in the projections and making a drive fit with the inner and outer projections and a freely rotating fit with the other. Other forms of pivotal connections or hinge means could be employed.

Figure 6:
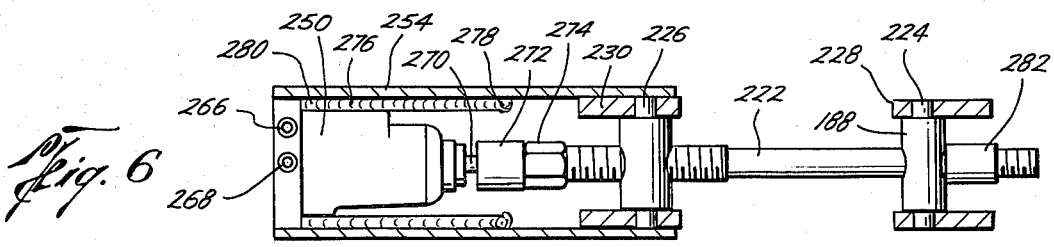
FIG. 6 is an enlarged elevation view of the connector and clamp shown in FIGS. 1 and 3.

Referring now to FIG. 6, the ends of clamp 30 are connected together by a screw 222. Screw 222 is pivotally connected by means including pivot rods 224, 226 to ears 228, 230. Ears 228 are welded to segment 200 and ears 230 are welded to segment 206.

Referring again to FIG. 2, adjacent internal shoulder 68 of outer support tube 56 engaging the top of bowl 65 of body 20 are exteriorally provided radially outwardly projecting, circumferential flanges 232, 234 formed by external annular grooves 236, 238 in outer support tube 56 and bowl 65, respectively. Flanges 232, 234 have back surfaces 237, 239 which taper as to decrease radial thickness of flanges 232, 234 as they proceed radially outward from outer support tube 56 and bowl 65. Surfaces 237, 239 constitute tapered wedging surfaces for the receipt of corresponding bevels on clamp 30 to hold top closure member 50 to body 20.

FIG. 2 illustrates that each clamp segment 200, 202, 204, 206 has a cross section providing upper and lower internal bevels 240, 242 to engage correlative tapered wedging surfaces 237, 239 on outer support tube 56 and bowl 65, respectively. It will be seen, therefore, that when screw 222 is turned, it will draw the clamp ring segments 200, 202, 204, 206 tightly about wedging surfaces 237, 239 of tube 56 and bowl 65 to wedge bowl 65 and outer support tube 56 together, forcing surface 44 of outer support tube 56 into sealing engagement with seat 66 of bowl 65.

Figure 7:
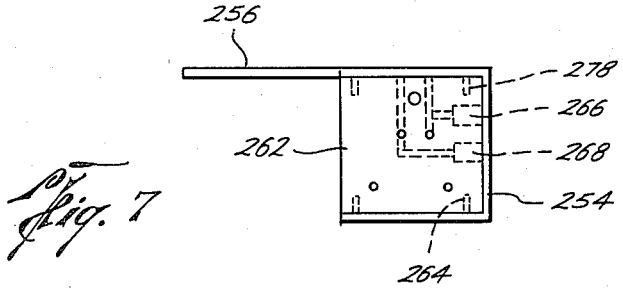
FIG. 7 is an end view of the connector shown in FIG. 6.

Referring now to FIGS. 3, 6, and 7, clamp opening and closing device 40 includes an impact motor 250 mounted within a support bracket 254. Support bracket 254, as best seen in FIGS. 3 and 7, has a generally channel-shaped cross section with one side having a generally triangular shaped extension 256. Support bracket 254 is mounted on segment 206 of clamp 30 by means of bolts 258, 260 passing through holes in extension 256 and being threadingly received in segment 206 of clamp 30. Impact motor 250 rests within the channel-like body of support bracket 254 for engagement with screw 222.

Ears 230 of clamp 30 along with one end of screw 222 is housed within support bracket 254.

Impact motor 250 may be of the type of impact wrenches described in U.S. Pat. Nos. 2,174,314; 2,184,394; 2,028,441; 2,256,496; 2,285,638; 2,341,497; 2,343,332; 2,371,982; 2,399,251; 2,408,228; 2,439,337; 2,463,656; 2,508,997; 2,514,914; 2,600,495; 2,801,718; 2,850,128; 3,000,244; 3,144,108; 3,174,597; 3,187,860; 3,414,066; and 3,703,933. An impact wrench often includes a pneumatic motor such as a vane motor but may be electric or hydraulic. A typical impact wrench includes a housing in which is journaled the rotor of a pneumatic motor. The drive shaft from the motor rotates a rotatable hammer. Although the hammer is not movable axially, the hammer carries with it in its rotation a pair of dogs which reciprocate by means of a cam mechanism to move into and out of the path of the jaws of an anvil. The anvil is journaled in the housing for making a driving connection with a work socket for drivingly engaging a workpiece. A clutch assembly is provided to declutch the dogs.

In operation, as for loosening a screw, the work socket of the anvil encounters a resistance torque substantially greater than the driving torque thereby activating the clutch to engage the dogs of the hammer which proceeds to deliver a series or succession of rapid and relatively powerful rotational hammer blows on the anvil member. Increased energy is thus supplied per impulse during the intermittent operation of the hammer to exert kinetic energy onto the work. The anvil applies repeated shocks to the workpiece by delivering a succession of rotational impulses having an instantaneous torque which exceeds the normal torque of the driving shaft. These successions of rotational hammer blows in the rotary direction causes the work socket to release and take hold at intervals, generally one per revolution of the motor shaft, using the momentum of the parts to apply these repeated impulses to the work. Thus the work (screw 222) is subjected to a series of impacts whenever the torsional force of the tool proves ineffective for performing the work. As the work such as screw 222 loosens, the driving torque decreases as resistance decreases until the hammer dogs are declutched whereby a high speed smooth rotary motion is applied to the work under the lower resistance forces. The reverse occurs in tightening the screw. The wrench imparts a continuous rotary motion to the work until the torque of the motor reaches a predetermined resistance causing the hammer to engage and provide rotary impact blows for tightening the screw. The clutch releases upon screw 222 becoming tight.

Impact motor 250 may be of several commercially available models including the Sears Air Impact Wrench Model 756.18882 which generates 10 to 200 footpounds of torque using 90 psig maximum air pressure. In using the Sears Air Impact Wrench, for example, the handle has been removed and a new backplate 262 is mounted at the rear of the air impact wrench by screws passing through holes 264 in the corners of backplate 262 for threaded engagement with the body of the air impact motor 250. Ports 266, 268 communicate from the exterior of backplate 262 for connection with air impact motor 250. Air lines with fittings are connected to ports 266, 268 and extend to control valves (not shown) at a remote location such as above drilling floor 34 for control of the operation of air impact motor 250.

The rotor shaft 270 on impact motor 250 includes a socket 272 for receiving nut 274 on the end of screw 222. The telescopic engagement of socket 272 and nut 274 is maintained by biasing impact motor 250 toward screw 222. Biasing means such as the four springs 276 are connected to support bracket 254 by eyes 278 and to backplate 262 at 280. Air impact motor 250 rests within support bracket 154 and is only connected to bracket 254 by means of springs 276. Backplate 262 is dimensioned so as to be loosely received within the channel-like body of support bracket 254 and yet not be permitted to rotate within support bracket 254. Thus, backplate 262 of air impact motor 250 prevents air impact motor 250 from rotation about the motor axis within support bracket 254 by its generally square cross section being received by the channel-like body of bracket 254. Grease fixtures may be provided in support 254 for lubricating the threads and/or impact motor 250.

A rubber boot (not shown) may be placed over clamp opening and closing device 40 and screw 222 for protection against dirt and corrosion. Further, the end of screw 222 opposite air impact motor 250 may have a protective tube 232 for protecting the threads.

In assembly drilling head 10, drilling head body 20 is lowered through rotary table 34 onto the top of the stack and is secured thereto. Top closure member 50 is then assembled by inserting inner seal tube 100 into outer support tube 56 whereby packing 64 of inner seal tube 100 sealingly engages bushing 106 of inner seal tube 100 and inner seal tube 100 is secured to outer support tube 56 by bolting retainer ring 58 to the top of outer support tube 56. Top closure member 50 is then lowered through rotary table 34 and onto conical seat 66 of bowl 65 of drilling head body 20. Top closure member 50 is connected to body 20 by means of clamp 30 and clamp opening and closing device 40. Drive bushing 70 is then received by inner seal tube 100 with spline 178 meshing for rotatable engagement. Slips 180 are then secured to drive bushing 70 for driving engagement between kelly 24 and drilling head 10. As kelly 24 rotates with master bushing 28 and rotary table 34, drive bushing 70, by means of spline 178 rotates inner seal tube 100 within outer support tube 56 by means of bearing means 90 and sealing engagement is established by means of packing 64 and bushing 106. Since clamp opening and closing device 40 securing top closure member 50 and drive bushing 70 to body 20 is remotely controlled from above the floor of the drilling rig, there is no need for workmen to go below the floor.

During the drilling operation when slips 180 are removed, the inner sleeve 176 of drive bushing 70 will pass over the connector at the lower end of kelly 24. Thereafter, when slips 180 are inserted between kelly 24 and the inner sleeve 176 of drive bushing 70 and fastened in place, kelly 24 can slide up and down within drive bushing 70 but not clear through it, being limited in its travel by connectors at its ends. When the drill string is elevated to add a length of pipe or to change the drill bit, kelly 24 is elevated and the connector at its lower end will engage the lower ends of slips 180. This will not prevent further elevation of kelly 24 since further movement will merely lift drive bushing 70 out of its socket. The larger diameter opening in top closure member 50 that remains when drive bushing 70 is removed, will leave plenty of room for the tool joint on the uppermost length of drill pipe to pass through. Although such tool joint will normally be no larger in diameter than the connector at the lower end of kelly 24, it might be misaligned with the center of the borehole, so it is of advantage to have a larger opening rather than trying to thread the joint through the smaller opening that would be left if only slips 180 were removed instead of the entire drive bushing 70. Also, it is faster to lift out drive bushing 70 than to remove the screws 181 holding slips 180 in place.

It will be noted from FIG. 1 that drive bushing 70 extends up inside master bushing 28 in rotary table 34. Utilization of this available space by elevating sandwich 175 of drive bushing 70 above splines 178 makes possible a reduction in diameter of bearing means 90. Bearing means 90 can therefore pass through small sized rotary tables too small to pass through body 20 of drilling head 10.

In the present invention, to remove and replace the top closure member 50 of drilling head 10, it is unnecessary to go below the rig floor to dismantle drilling head 10 and slip it out from underneath the rig floor. For example, when it is desired to change bits, master bushing 28 is removed from rotary table 34. Impact motor 250 is remotely activated from above the rig floor to actuate clamp 30. Initially motor 250 encounters resistance from screw 222 causing motor 250 to deliver a series or succession of rapid and powerful rotational hammer blows to screw 222. The succession of rotational hammer blows applying an instantaneous torque to screw 222 will break open clamp 30 even where clamp 30 has corroded and is frozen shut. Once screw 222 turns and clamp 30 begins to release, the driving torque of motor 250 decreases until a high speed rotary motion is applied to screw 222.

In releasing clamp 30, screw 222 is turned in the opposite direction from that used in tightening clamp 30. Such turning of screw 222 separates ears 228, 230 of segments 200, 206 pivoting about knuckle joints 208, 212 until segments 200, 206 engage stops 244, 246. These stops are radially spaced from segments 200, 206 when the latter are drawn up tight as shown in FIG. 2. After segments 200, 206 engage stops 244, 246, further separation of ears 228, 230 cause segments 202, 204 to slide longitudinally past stops 244, 246 and push tangentially on knuckle joints 208, 212, thereby moving clamp ring segments 202, 204 away from the center of drilling head 10, guidestops 248, 252 insuring uniform outward motion of the segments and ultimately limiting their motion to just far enough to free top closure member 50 without clamp 30 dropping off drilling head body 20. Clamp 30 therefore remains in a position for re-engagement with top closure member 50 whenever desired. A further limit on circumferential expansion of clamp 30 can be provided by one or more stop nuts screwed on to screw 222.

After clamp 30 has been fully opened, top closure member 50 and drive bushing 70 are lifted out of drilling head 10. To facilitate such removal, top closure member 50 is provided with threaded holes into which screw eyes may be inserted for aid in lifting top closure member 50. Unless it is desired to keep the annulus closed while pulling the drill string, top closure member 50 and drive bushing 70 can be removed at the beginning of the trip by engagement of the kelly connector with the lower end of the stripper 80 causing top closure member 50 and drive bushing 70 to be drawn out with kelly 24. Because bushing 62 and cartridge 64 are lubricated by means of lubrication ports 110, 112, annular recess 114 and port 116 communicating with annular groove 118 opening to radial port 122 in drilling head body 20, no oil lines need be disconnected to remove top closure member 50.

Thus, the present invention has the overall advantages of permitting the removal and replacement of top closure member 50 without going underneath the rig floor. This requires (1) a top closure member that will pass through the rotary table, (2) lubrication that does not have to be disconnected by going under the rotary table, and (3) a remotely operated clamp that will disconnect the top closure member from the drilling head body and can be actuated from above the rig floor. The impacting variable torque motor insures that if the clamp sticks, the motor will be able to aply a high impacting torque to the clamp screw.

While a preferred imbodiment of the invention has been shown and described, modifications thereof can be made by one skilled in the art within departing from the spirit of the invention.

I claim:

1. A drilling head for attachment to a drilling control stack member, comprising:

a tubular body having a flow bore therethrough and a side bore;

a closure member cooperatively engaging said body around one end of said flow bore and having a bore adapted to receive a drive tube extending through said flow bore;

means for attaching the other end of said flow bore to the drilling control stack member;

securement means for releasably securing said closure member to said body, said securement means including a plurality of segments engageable with surfaces of said closure member and said tubular body, the juncture of said segments being hinged together excepting at one juncture joined by a variable length linkage;

said variable length linkage drawing said segments tightly around said closure member and tubular body for securing said member and body together and loosening said segments around said closure member and tubular member for unsecuring said member and body;

an impact motor for applying a variable torque to said variable length linkage for actuating said securement means, said impact motor imparting a continuous rotary motion to said variable length linkage for securing said member and body until the torque of said impact motor receives a predetermined resistance from said variable length linkage causing said impact motor to impart a series of rotary impact blows to said variable length linkage to tightly secure said segments around said member and body, said impact motor delivering a succession of rotational hammer blows to said variable length linkage to initiate the actuation of said variable length linkage for unsecuring said member and body and decreasing the torque applied to said variable length linkage until a smooth rotary motion is applied to unsecure said segments from around said member and body.

2. The drilling head according to claim 1 wherein said variable length linkage includes a nut pivotally connected to one segment, a screw engaged with said nut, and pivotal means pivotally connecting said screw with another segment;

said impact motor includes a housing and a drive shaft connected to said screw adjacent said pivotal means permitting relative movement between said drive shaft and screw along the torque axis and rotation of said screw relative to said nut; and further including support means mounted on said securement means for supporting said impact motor while permitting limited rotational and longitudinal movement of said housing with respect to said support means, said support means preventing complete rotation of said housing; and means for biasing said housing toward said screw to maintain the connection between said screw and said drive shaft.

3. The drilling head according to claim 2 wherein said variable torque generates between 10 and 200 foot-pounds.

4. The drilling head according to claim 2 wherein said impact motor is operated by air pressure.

5. The drilling head according to claim 2 wherein said support means on said securement means permits limited movement of said impact motor in any direction.

6. The drilling head according to claim 2 wherein said drive shaft includes connector means for making a drive connection with said linkage.

7. A drilling head comprising:

a tubular body having a bottom opening, a top opening and a side opening;

connector means at the bottom opening for facilitating connecting the body to a drilling control stack member therebelow;

top closure means for closing off the annulus between a portion of the body above said side opening and a drive tube when such a tube is extending through the body, said top closure means including an outer member connected to the body and an inner member rotatably supported by said outer member, said inner member being provided with a stripper engageable with such a drive tube;

clamp means for releasably securing said top closure means to said body, said clamp means having several segments engageable with surfaces of said body and said outer member, the juncture of said segments being hinged together excepting at one juncture joined by a varible length linkage, said variable length linkage including a nut pivotally connected to one segment, a screw engaged with said nut, and pivotal means pivotally connecting said screw with another segment;

motor means having a drive shaft engaging said variable length linkage for actuation thereof and a housing with an impact motor for rotating said drive shaft;

connection means for transmitting torque from said drive shaft to said screw for rotation thereof relative to said nut, said connection means permitting relative movement therebetween along the torque axis;

support means on said clamp means for supporting said motor means while permitting limited movement of said motor means in any direction, said support means permitting limited rotation of said housing while preventing complete rotation thereof, said another segment being pivotally mounted on said support means;

means for biasing said motor means against said variable length linkage at said connection means;

motor means having a variable torque for applying said variable torque to said clamp means for actuation thereof, said motor means applying a series of rotational impulses to said variable length linkage to initially loosen and finally tighten said clamp means and a continuous rotary motion to loosen and tighten said clamp means; and a side outlet comprising a tube having means at its outer end for facilitating connecting the tube to a drilling fluid line, the inner end of said tube being releasably connected to said body in communication with said side opening whereby when said side outlet is removed the remainder of the drilling head can be lowered through the master bushing receiving opening of a rotary table provided for rotating such a drive tube, said remainder of the drilling head having a maximum transverse dimension no larger than the minimum transverse dimension of said opening in the rotary table.

8. A drilling head comprising:

a tubular body adapted at its lower end for connection to a lower well control element;

closure means for closing the annulus between the body and a drive tube when extended axially through the body;

securement means for releasably securing said closure means to said body;

motor means having a variable torque for applying said varible torque to said securement means for the actuation thereof, said motor means applying a series of rotational impulses to said securement means to initially loosen and finally tighten said securement means and a continuous rotary motion to loosen and tighten said securement means;

said closure means including a support tube, a seal tube mounted relative to said support tube, and seal means to seal between said support tube and seal tube;

said securement means having several segments engageable with surfaces of said body and said support tube, the juncture of said segments being hinged together excepting at one juncture joined by a variable length linkage, said variable length linkage including a nut pivotally connected to one segment, a screw engaged with said nut, and pivotal means pivotally connecting said screw with another segment;

said motor means having a drive shaft engaging said securement means for actuation thereof and a housing with an impact motor for rotating said drive shaft;

connection means for transmitting torque from said drive shaft to said screw for rotation thereof relative to said nut, said connection means permitting relative movement therebetween along the torque axis;

support means on said securement means for supporting said motor means while permitting limited movement of said motor means in any direction, said support means permitting limited rotation of said housing while preventing complete rotation thereof, said another segment being pivotally mounted on said support means;

means for biasing said motor means against said securement means at said connection means;

said seal means comprising annular packing means carried by said support tube and an annular sealing surface on said seal tube in sealing engagement with said packing means; and said seal tube including sealing means to seal between said seal tube and said drive tube.

9. A drilling head comprising:

a tubular body adapted at its lower end for connection to a lower well control element;

closure means for closing the annulus between the body and a drive tube when extended axially through the body;

securement means for releasably securing said closure means to said body;

motor means having a variable torque for applying said variable torque to said securement means for the actuation thereof, said motor means applying a series of rotational impulses to said securement means to initially loosen and finally tighten said securement means and a continuous rotary motion to loosen and tighten said securement means;

said closure means including a support tube, a seal tube mounted relative to said support tube, and seal means to seal between said support tube and seal tube;

said seal means comprising annular packing means carried by said support tube and an annular sealing surface on said seal tube in sealing engagement with said packing means;

said securement means having several segments engageable with surfaces of said body and said support tube, the juncture of said segments being hinged together excepting at one juncture joined by a variable length linkage, said variable length linkage including a nut pivotally connected to one segment, a screw engaged with said nut, and pivotal means pivotally connecting said screw with another segment;

said motor means having a drive shaft engaging said securement means for actuation thereof and a housing with an impact motor for rotating said drive shaft;

connection means for transmitting torque from said drive shaft to said screw for rotation thereof relative to said nut, said connection means permitting relative movement therebetween along the torque axis;

support means on said securement means for supporting said motor means while permitting limited movement of said motor means in any direction, said support means permitting limited rotation of said housing while preventing complete rotation thereof, said another segment being pivotally mounted on said support means;

means for biasing said motor means against said securement means at said connection means; and said securement means further including a plurality of circumferentially spaced guide means, one for each segment, said guide means being affixed to said body to limit pivotal outward movement of each of said pair of segments about its hinged juncture with the segment adjacent thereto upon increase in the length of said linkage and thereby causing radial outward movement of said adjacent segment of said securement means, segments of said clamp means farthest from said variable length linkage having stop means engageable with said guide means on said body to orient said clamp meand azimuthally about the body axis relative to said guide means.

10. A drilling head comprising:

a tubular body adapted at its lower end for connection to a lower well control element;

closure means for closing the annulus between the body and a drive tube when extended axially through the body;

securement means for releasably securing said closure means to said body;

motor means having a variable torque for applying said variable torque to said securement means for the actuation thereof, said motor means applying a series of rotational impulses to said securement means to initially loosen and finally tighten said securement means and a continuous rotary motion to loosen and tighten said securement means;

said closure means including a support tube, a seal tube mounted relative to said support tube, and seal means to seal between said support tube and seal tube;

said securement means having several segments engageable with surfaces of said body and said support tube, the juncture of said segments being hinged together excepting at one juncture joined by a varible length linkage, said variable length linkage including a nut pivotally connected to one segment, a screw engaged with said nut, and pivotal means pivotally connecting said screw with another segment;

said motor means having a drive shaft engaging said securement means for actuation thereof and a housing with an impact motor for rotating said drive shaft;

connection means for transmitting torque from said drive shaft to said screw for rotation thereof relative to said nut, said connection means permitting relative movement therebetween along the torque axis;

support means on said securement means for supporting said motor means while permitting limited movement of said motor means in any direction, said support means permitting limited rotation of said housing while preventing complete rotation thereof, said another segment being pivotally mounted on said support means;

means for biasing said motor means against said securement means at said connection means;

said seal means comprising annular packing means carried by said support tube and an annular sealing surface on said seal tube in sealing engagement with said packing means;

said seal tube including sealing means to seal between said seal tube and such drive tubes;

said closure means including drive means releasably carried by said seal tube engageable with such drive tube;

said drive means including a shock absorber;

said drive means comprising an inner metal sleeve, an outer metal sleeve, and an elastomer sleeve between and secured to said inner and outer sleeves;

said outer sleeve having spline means on its outer periphery;

said seal tube having spline means on its inner periphery cooperable with said spline means on said outer sleeve; and drive tube engageable slips at the inner periphery of said inner sleeve releasably secured to said drive means.

11. Drilling apparatus comprising:

a wellhead having a tubular body with a radial flange at the lower end of the body adapted for connection to other drilling apparatus such as a blowout preventer, said well-head having a support tube, said suppot tube having above said flange first bearing support means;

said body having above said flange and below said first bearing support means a side flow port through the side wall of said tubular body with pipe connection means about said side flow port for connecting a flow pipe to said support tube in communication with said side flow port;

a seal tube rotatably disposed in said support tube, said seal tube having a non-circular socket;

said seal tube further including drive bushing means having a non-circular outer portion nonrotatably received in said socket and axially upwardly supported by said seal tube, said drive bushing means having an opening adapted to receive a drive tube such as a kelly rotated by a rotary table or the top joint of a drill string rotated by a power swivel;

securement means for releasably securing said support tube and said body;

motor means having a variable torque for actuating said securement means, said motor means applying a series of rotational impulses to said securement means to initially loosen and finally tighten said securement means and a continuous rotary motion to loosen and tighten said securement means;

said securement means having several segments engageble with surfaces of said body and said outer member, the juncture of said segments being hinged together excepting at one juncture joined by a variable length linkage, said variable length linkage including a nut pivotally connected to one segment, a screw engaged with said nut, and pivotal means pivotally connecting said screw with another segment;

said motor means having a drive shaft engaging said securement means for actuation thereof and a housing with an impact motor for rotating said drive shaft;

connection means for transmitting torque from said drive shaft to said screw for rotation thereof relative to said nut, said connection means permitting relative movement therebetween along the torque axis;

support means on said securement means for supporting said motor means while permitting limited movement of said motor means in any direction, said support means permitting limited rotation of said housing while preventing complete rotation thereof, said another segment being pivotally mounted on said support means;

means for biasing said motor means against said securement means at said connection means;

said seal tube further including second bearing support means;

bearing means, carried by said first and second bearing support means, rotatably supporting said seal tube by said support tube;

first seal means for sealing between said seal tube and said support tube;

said first seal means being below said drive bushing means and below said bearing means and above said side flow port;

second seal means carried by said seal tube adapted to seal between said seal tube and such drive tube below said first seal means; and said second seal means being below such drive bushing means and below said bearing means and extending downwardly into said tubular body to a level adjacent said side flow port.

* * * * *

UNITED STATES PATENT AND TRADEMARK OFFICE

CERTIFICATE OF CORRECTION

PATENT NO. : 4,416,340

DATED : November 22, 1983

INVENTOR(S) : Edmond I. Bailey

It is certified that error appears in the above—identified patent and that said Letters Patent is hereby corrected as shown below:

Column 6, line 9; change "retaining" to -- retainer --.

Column 6, line 45; change "rabbit" to -- rabbet --.

Column 7, line 5; change "rabbit" to -- rabbet --.

Column 7, line 14; change "rabbit" to -- rabbet --.

Column 7, line 16; change "fanges" to -- flanges --.

Column 10, line 22; change "assembly" to -- assemblying --.

Column 16; line 21; change "varible" to -- variable --.

Column 17; line 2; change "suppot" to -- support --.

Signed and Sealed this

*Fourteenth* Day of *February 1984*

[SEAL]

*Attest:*

GERALD J. MOSSINGHOFF

*Attesting Officer*

*Commissioner of Patents and Trademarks*